United States Patent [19]

De Rycke

[11] Patent Number: 4,888,267

[45] **Date of Patent: * Dec. 19, 1989**

[54] METHOD FOR PROCESSING A PHOTOGRAPHIC MATERIAL

[75] Inventor: Gino L. De Rycke, Mortsel, Belgium

[73] Assignee: AGFA-Gevaert N.V., Mortsel, Belgium

[ * ] Notice: The portion of the term of this patent subsequent to Oct. 4, 2005 has been disclaimed.

[21] Appl. No.: 187,917

[22] Filed: Apr. 29, 1988

[30] Foreign Application Priority Data

May 6, 1987 [EP] European Pat. Off. ..... 87200834

[51] Int. Cl.[4] ..... G03C 5/54; G03C 5/38

[52] U.S. Cl. ..... 430/206; 430/231; 430/251; 430/404

[58] Field of Search ..... 430/206, 404, 231, 428, 430/429, 251

[56] References Cited

U.S. PATENT DOCUMENTS

| | | | |
|---|---|---|---|
| 2,740,717 | 4/1956 | Yutzy et al. | 430/206 |
| 3,179,517 | 4/1965 | Tregillus et al. | 430/206 |
| 3,647,464 | 3/1972 | Smith et al. | 430/206 |
| 4,775,614 | 10/1988 | De Rycke | 30/206 |

OTHER PUBLICATIONS

Chem. Abs. No. 187247d; vol. 107, 1987, Abstact of E. P. No. 221,599.

*Primary Examiner*—Richard L. Schilling
*Attorney, Agent, or Firm*—William J. Daniel

[57] ABSTRACT

An ecologically clean method for processing an image-wise exposed photographic material having a silver halide emulsion layer which method comprises the steps of:

(A) developing the image-wise exposed photographic material by means of at least one diffusible developing agent in the absence of such an amount of silver halide solvent that would reduce the coverage of developed silver metal (Ag/m2) by more than 20% using an aqueous alkaline liquid.

(B) bringing the thus developed photographic material while being still wet with the liquid used in step (A) with its silver halide emulsion layer side in intimate contact with a water-absorbing layer of a receptor element that contains in an organic hydrophilic colloid binder a silver halide complexing agent, also called silver halide solvent, and in dispersed form silver metal nuclei, (C) maintaining said photographic material and receptor element in such contact to allow the transfer of dissolved complexed silver compound into the absorbing layer of the receptor element until the undeveloped silver halide in the exposed silver halide emulsion layer is substantially completely removed and a silver metal precipitate on said nuclei is formed in the receptor element, and (D) separating the photographic material from the receptor element, said water-absorbing layer containing said silver metal nuclei at a coverage of at least 0.1 g/m2, and said silver complexing agent at a coverage per m2 corresponding with at least 5 mole % of the molar coverage per m2 of silver halide in the unexposed photographic material.

17 Claims, No Drawings

METHOD FOR PROCESSING A PHOTOGRAPHIC MATERIAL

The present invention relates to a method for rapid and ecologically clean processing of an exposed photographic silver halide emulsion element wherein the removal of undeveloped silver halide from a developed photographic element proceeds with a particularly small amount of liquid in an absorbing element containing a silver ion complexing agent and silver nuclei for silver metal precipitation.

Silver halide emulsion materials with all their enormous advantages in sensitivity, spectral sensitisation and capability of producing black-and-white and colour images with strong optical density and high resolving power have the drawback or requiring in conventional processing several processing liquids and a time consuming drying for the final image. Particularly the fixing and rinsing steps are of relatively long duration when archival image quality is desired. Moreover, exhausted fixing liquids and even wash liquids containing dissolved silver pose an ecological problem because silver ions are allowed to be drained off into the sewer only in a very limited quantity. Further, silver recovery from fixing liquids in large scale processing is nowadays a must for its economic importance and proceeds by the deposition of dissolved silver as metal or silver precipitate from the fixing liquid in bulk.

Under the impulse of these specific drawbacks and requirements associated with the conventional processing of photographic silver halide emulsion materials there has been a constant search for a rapid ecologically clean processing being as dry as possible and offering archival high quality images.

In a successful rapid access processing known as diffusion transfer reversal (DTR-) processing [ref. Photography - Its Materials and Processes - by C. B. Neblette - 6th ed. D. Van Nostrand Company - New York (1962), p. 372] an exposed silver halide emulsion material is developed in the presence of a silver halide solvent or complexing agent. Hereby the non-developed silver halide is complexed and transferred by diffusion into an image-receiving material to form therein a silver image by reduction with the aid of a developing agent in the presence of minute amounts of so-called development nuclei, e.g. colloidal silver or heavy metal sulphides.

Many efforts and much research were devoted to the achievement of diffusion transfer images of high quality in the image receiving material with reduced amount of silver halide in the light-sensitive material as compared with the conventional processing. These efforts and research directed to a large choice of development nuclei, black-toning agents, binding agents, etc..., led for many purposes to satisfactory image quality in the image receiving material. In some fields of image reproduction, e.g. the graphic arts field, however, where in some applications particular sharpness, high resolving power or other extreme sensitometric qualities are required the formation of the final image in the photosensitive material by conventional processing, i.e. image formation not based on diffusion transfer of image forming substances, is still preferred.

In a rapid access processing method described by Tregillus in GB-P 964,514 and U.S. Pat. No. 3,179,517 an exposed photographic silver halide emulsion layer is developed and fixed simultaneously (as is the case in monobath-processing), the said method comprising the following steps: (A) bringing the exposed layer into intimate contact with a water-absorbant, organic colloid processing web under the following conditions;

(i) either the exposed layer or the web has been preimbibed with aqueous liquid, (ii) a photographic silver halide developing agent has been incorporated either in the emulsion layer or in the web before contact, provided that where the developing agent has been incorporated in the emulsion layer, development is not allowed to commence before contact, (iii) the processing web has incorporated therein before contact an organic amine-sulphur dioxide addition product, at least one silver halide solvent and sufficient silver precipitating agent to precipitate the whole of the silver halide complex which will diffuse into the web during step (B);

(B) maintaining the emulsion layer and processing web in contact until development of a silver image in the emulsion layer is complete and substantially all the silver halide has been removed from the emulsion layer and precipitated in the processing web; and (C) separating the emulsion layer from the processing web.

From experiments it was learned that by the competitive fixing and development reactions a part of the exposed silver halide of a negative working silver halide layer becomes dissolved by the silver halide solvent and diffuses into the web, which results in a decreased image density in the photographic material.

Further, it has been established by us that by the procedure of Example 10 of the Tregillus US-patent wherein zinc sulphide as sole silver ion scavenging agent is used an image having a brown stain and rather high brown fog in the non-image area of the photographic silver halide emulsion material is obtained.

In U.S. Pat. No. 3,647,464 a processing web is described for the processing of photographic silver halide emulsion materials with a minimum of processing liquid. In said processing web the binding agent of the processing layer for improving alkali resistance is a sulfonated polyvinyl alcohol derivative. As in the above discussed Tregillus process, development of the imagewise exposed photographic material proceeds together with fixing by using a processing liquid comprising an alkaline solution of one or more developing agents and a silver halide solvent (complexing). The processing web of U.S. Pat. No. 3,647,464 may also be employed to process silver salt-sensitized emulsion layers containing incorporated developing agent. In this embodiment the silver halide developing agent is omitted from the processing solution since it is already present in the emulsion layer. By the fact however, that developing agent(s) and silver halide solvent are both present simultaneously in the processing step a rather large portion of exposed still not developed silver halide will be removed giving rise to loss of fine image details and a drop in maximum optical density.

It is an object of the present invention to provide a method for a rapid processing of an exposed photographic silver halide emulsion element comprising separate steps of development and fixing using a fairly small amount of liquid and yielding images of high quality and resolving power without long duration drying.

It is a further object of the present invention to provide a more ecologically clean processing of photographic silver halide emulsion materials than the processing wherein for fixing purposes as silver ion scavenging agent a rather large amount of heavy metal sulphide such as zinc sulphide is used.

It is further one of the objects of the present invention to provide a stable receptor element for use in said method and wherefrom silver can be easily recovered without problems resulting from the presence of substantial amounts of other metals.

Other objects and advantages of the present invention will appear from the further description.

According to the present invention there is provided an ecologically clean method for processing an image-wise exposed photographic silver halide emulsion material which method comprises the steps of:

(A) developing an image-wise exposed silver halide emulsion layer by means of (a) diffusible developing agent(s) in the absence of such an amount of silver halide solvent or complexing agent that would reduce the coverage of developed silver metal (Ag/m2) by more than 20%, using an aqueous alkaline liquid having preferably a pH of at least 9, more preferably of at least 11, (B) bringing the thus developed photogrpahic material while still wet with the liquid used in step (A) with its silver halide emulsion layer side in intimate contact with a water-absorbing layer of a receptor element that contains in an organic hydrophilic colloid binder a silver halide complexing agent, also called silver halide solvent, and in dispersed form silver metal nuclei, (C) maintaining said photographic material and receptor element in contact to allow the transfer of dissolved complexed silver compound into said receptor element until the undeveloped silver halide in the exposed silver halide emulsion layer is substantially completely removed and a silver metal precipitate on said nuclei is formed in the receptor element, and (D) separating the photographic material from the receptor element, said water-absorbing layer containing said silver metal nuclei at a coverage of at least 0.1 $g/m^2$, and said silver complexing agent at a coverage per m2 corresponding with at least 5 mole % of the molar coverage per m2 of silver halide in the unexposed photographic material.

In a preferred embodiment for avoiding loss of developable silver halide in the still developing silver halide emulsion material, step (A) is carried out in the complete absence of silver halide solvent. The preparation of the silver nuclei proceeds e.g. by a process known for the production of colloidal silver. A suitable type of colloidal silver is known under the name Carey Lea silver the preparation of which proceeds by the reduction of silver nitrate using iron(II) sulphate described e.g. in "Kolloidchemisches Praktikum" by Dr. E. Sauer - Berlin - Verlag von Julius Springer (1935), p. 25.

In many other cases, however, the reduction proceeds with organic reducing agents in alkaline hydrophilic colloid medium. For example the production of colloidal yellow silver proceeds as described in "Photographic Chemistry" by P. Glafkidès - Vol. 2. - Fountain Press -London, (1960), p. 567–568 and in U.S. Pat. No. 2,688,601 and in BE-P 622,695.

The silver metal nuclei may be used in combination with other metal nuclei, e.g. nickel nuclei, acting as a catalyst in the reduction of silver ions.

According to a particular embodiment the decomposition of the silver complex compound transferred into the receptor element is speeded up by using in water-permeable relationship with said colloidal silver metal nuclei an amount of colloidal heavy metal sulphide, preferably zinc sulphide, corresponding with a coverage in the range from 2.05x10-4/m2 to $2.05\times10^{-2}/m^2$. By heavy metal sulphide is understood a metal sulphide wherein the metal has an atomic number at least 24. Examples of such metals are : chromium, nickel, cobalt, copper, tin, silver, gold, mercury, platinum, lead, cadmium, palladium, antimony and zinc.

By colloidal heavy metal sulphide is understood a heavy metal sulphide with an average particle size not larger than 0.1 um not excluding however, conglomerates thereof.

In a particular embodiment the heavy metal sulphide is present in another hydrophilic colloid layer than the one containing the colloidal silver metal nuclei, e.g. zinc sulphide for a conversion reaction with silver ions forming a silver sulphide precipitate and setting free zinc ions is present in a waterpermeable topcoat and a subcoat contains the silver metal nuclei for silver precipitation by redox reaction, or vice versa.

In another particular embodiment the silver halide solvent and/or developing agent is (are) used in a layer different from a waterpermeable layer containing the colloidal silver metal nuclei and/or colloidal heavy metal sulphide such as zinc sulphide but in water-permeable relationship therewith, e.g. in a waterpermeable topcoat or subcoat containing a hydrophilic colloid binder and having a thickness e.g. in the range from 10 μm to 100 μm.

The preparation of colloidal heavy metal sulphide for use in an embodiment of the present invention proceeds e.g. in aqueous medium by mixing a solution of a water-soluble heavy metal salt with hydrogen sulphide or a solution of a water-soluble ammonium or alkali metal sulphide. The colloidal product formed by said mixing is freed, e.g. by washing, from residual watersoluble salt so that no excess of free sulphide and salt formed in the reaction is present. During the precipitation of the colloidal poorly water-soluble heavy metal sulphide optionally a hydrophilic colloid, e.g. colloidal silica, may be present.

For formation by deposition of colloidal silver and optionally colloidal silver sulphide in the photographic material is substantially avoided by contacting the still wet developed photographic material with an initially dry receptor element.

In particularly practical embodiments the said receptor element is used in the form of a web or sheet.

Normally a quantity of alkaline aqueous processing liquid in the range of 20 to 60 ml per $m^2$ are soaked up in the photographic material on development.

The water-absorbing layer(s) of the receptor element act as a kind of sponge and make it possible to obtain very rapidly almost dry photographic copies after completing the transfer of the undeveloped complexed silver halide into said receptor element.

Any known silver halide solvent may be used in the process of the present invention but best results are obtained with a watersoluble thiosulphate such as sodium thiosulphate. The coverage of such thiosulphate in the receptor element is preferably in the range of 0.50 to 5 g per $m^2$.

These relatively small amounts of said silver halide solvent are sufficient since the latter is regained in the precipitation of the complexed silver as silver and will be used in complexing again and again till complete extraction of the silver halide from the silver halide emulsion layer.

For use in combination with commercially available black-and-white photographic silver halide emulsion material the receptor element, e.g. sheet or web, of the present invention preferably has a coverage of colloidal silver metal nuclei in the range of 0.1 to 3 g per m2 which is necessary for sufficiently complete fixing of said silver halide emulsion materials having normally a silver halide coverage in a range corresponding with 1.7 g to 78.5 g of silver nitrate per m2. In the receptor material the average grain size of the colloidal silver nuclei is preferably less than 1 μm.

According to a particular embodiment the receptor element contains in waterpermeable relationship with said silver metal nuclei an amount of colloidal zinc sulphide corresponding with a coverage in the range from $2.05\times10^{-4}$ mole/m$^2$ to $2.05\times10^{-2}$ mole/m$^2$.

Suitable hydrophilic organic colloids for use as binding agent in a water-absorbing layer of the processing element used according to the present invention are of the type known from photographic silver halide emulsion materials. Examples of useful hydrophilic colloid binding agents are: gelatin, polyvinyl alcohol, polyvinyl pyrrolidinone, polyacrylamide, methyl cellulose and carboxymethyl cellulose that may form coating solutions with fairly high viscosity.

Other ingredients that may be present in a water-absorbing layer of the receptor element, e.g. for reducing stickiness, are polymers applied from an aqueous polymer dispersion, i.e. latex. For that purpose polymethyl methacrylate latex is particularly useful.

The thickness of a water-absorbing layer or packet of water-absorbing layers is e.g. from 5 to 35 um preferably in the range from 10 to 30 um. The organic hydrophilic colloid binder is preferably present in the range of 4 to 10 g per m2.

In order to speed up the reduction (physical development) of complexed silver on the silver nuclei of the receptor element it is advantageous to incorporate therein in waterpermeable relationship with said nuclei a silver halide developing agent, e.g. a hydroquinone and/or a 3-pyrazolidinone type developing agent. A useful coverage of developing agent is in the range of 0.1 g/m2 to 2 g/m2.

In order to avoid as much as possible the staining of the exposed and developed photographic siliver halide emulsion material with oxidized developing agent stemming from the receptor sheet, the developing agent incorporated in the receptor sheet is of the diffusion resistant type. Examples of such developing agents, e.g. 3,4-dihydroxy diphenyl are described in U.S. Pat. No. 2,740,717 or diffusion resistant hydroquinone type compounds containing at least one substituent including at least 6 C-atoms in consecutive order prepared as described in EP 0069068, e.g. 2'- 5'-bis(5-n-hexyloxycarbonyl-2-methyl-pent-yl)-hydroquinone.

In order to protect the developing agent(s) in the receptor sheet against aerial oxidation commoon developer preservatives, e.g. a sulphite compound, ascorbic acid and reductones may be incorporated therein.

In a receptor sheet or web of the present invention the water-absorbing layer containing the silver metal nuclei and any other layer as described above is applied on a support that is preferably flexible. Particularly suited supports are paper and resin supports of the type known in photographic silver halide emulsion materials.

The liquid used for carrying out the development of the photographic material may be applied in any way known to those skilled in the art, e.g. by dipping or spraying.

According to a preferred embodiment the liquid used in the development is applied by meniscus coating in a tray device and the photographic material is led through conveying rollers whereby it is possible to apply only very small amounts of liquid, e.g. in the range of 20 to 60 ml per m2 that are consumed almost completely so that no or only a minor amount of processing liquid is returned into the liquid container so that development takes place always with fresh processing liquid and no waste liquid is left or formed.

The presence of swellable hydrophilic colloidal substances in the receptor sheet or web inparts sufficient liquid absorption power as to act as a ponge so that the photographic material after its separation is left substantially dry, certainly when the contacting proceeds at elevated temperature. The consequential omission or shortening of a drying step is a real advantage at the benefit of rapid access and energy saving.

According to a particular embodiment applied in instant photography the developing liquid is made available in a liquid container, a so-called "pod" associated with the photographic silver halide emulsion material (see Neblette's Handbook of Photography and Reprography, 7th ed. Edited by John M. Sturge (1977) p. 282–285).

Other techniques for providing processing liquid in situ in a photographic silver halide emulsion material operate with micro-capsules that are pressure and/or heat rupturable. Examples of such micro-capsules, their preparation and use are described in GB-P 1,034,437 and 1,298,194. In another technique applied for almost dry processing use is made of photographic materials incorporating the photographic processing substances in so-called thermosolvents that are substances solid at room temperature obtaining wetting capacity on melting by heating the photographic material. Examples of thermosolvents also called "heat-solvents" and their use in photographic materials are described e.g. in U.S. Pat. No. 3,438,776, published European Patent Application 0 120 306 and published DE-A No. 3 215 485. In the latter Patent Applications dye diffusion transfer materials incorporating developing agents and thermosensitive base releasing compounds are described that after image-wise exposure are heated, e.g. up to 110° C., to release a free base and are processed with plain water, optionally at elevated temperature.

For energy saving reasons the fixing of the undeveloped silver halide is carried out preferably in the temperature range of 15° C. to 30° C. but may be speeded up by increase of the temperature, so that steps (B) and (C) of the present process are carried out e.g. in the temperature range of 15° C. to 110° C.

A particularly rapid transfer of the silver complex compounds and silver precipitation in the receptor web or sheet containing silver metal nuclei proceeds at elevated temperature in the range of 30° to 110° C. The heating can be carried out by bringing the photographic material contacting the receptor sheet or web between heated plates or rollers or by irradiation with infra-red light or any other heating technique applied in the photographic processing art.

It has been found experimentally that the treatment of the developed photographic material with an acid stop bath or neutral rinsing liquid is retarding the access to the final image not only because such treatment takes time but also because the lowering of the pH in the photographic material and receptor element slows down the speed of fixing and silver precipitation.

A final wash (rinsing) of the silver halide emulsion material after its contact with the present receptor element, e.g. sheet or web, is not strictly necessary but may be beneficial if for some or other reason residual stain, e.g. due to residual developing agent has to be removed.

The present process offers a particularly rapid access to the fixed photographic print when the photographic material in exposed state contains already the necessary developing agent(s) and the processing is carried out with an aqueous alkaline liquid, called activator liquid, having preferably a pH of at least 9, more preferably of at least 11.

In a particular embodiment the silver halide emulsion materials contain the necessary developing agent(s) in combination with a base generating or base releasing agent, hereby the alkalinity of the aqueous liquid used in step (A) can be obtained in situ from substances incorporated in the photographic material itself.

According to one embodiment a base generating system is used wherein a photographic silver halid emulsion material contains as described e.g. in U.S. Pat. No. 3,260,598 and in published European Patent Application 0 210 659 a slightly soluble metal compound such as zinc oxide and in an aqueous processing liquid a substance that by reaction with said compound yields hydroxyl ions. Such a substance is e.g. sodium picolinate acting as complexing agent for zinc ions. Using such base generating system the aqueous processing liquid on contact with said photographic material becomes alkaline in situ in step (A).

According to another embodiment a thermally base generating compound is used in the photographic material which after its image-wise exposure is heated for releasing a free base so that the liquid treatment of the photographic material in step (A) initially starts with plain water to effect development in the presence of a base released in the photographic material. Typical base-releasing agents for use in such photographic materials are described in GB-P No. 998,949 and in DE-OS No. 3,529,934.

The process of the present invention can be applied in conjunction with any type of silver halide, e.g. silver chloride, silver bromide, silver chlorobromide, silver bromide-iodide or mixtures thereof. A survey of silver halide emulsion preparation, their chemical and spectral sensitisation and stabilisation against fog is given e.g. in Research Disclosure December 1978, item 17643 titled "Photographic silver halide emulsions, preparations, addenda, processing and systems".

Silver chloride emulsions having a silver chloride coverage corresponding with an amount equivalent to 3 g of silver nitrate per m2 can according to the present invention be freed from silver chloride in less than 60 s by contacat with said sheet or web at 20° C.

Photographic materials in the form of a sheet may be fixed in contact with receptor materials in sheet form, e.g. by conveying them in contact between pressure rollers as are present in classical diffusion transfer reversal apparatus some types of which are described in "Photographic Silver Halide Diffusion Processes" by André Rott and Edith Weyde, Focal Press - London - New York (1972) p. 242–256.

Photographic materials are advantageously processed likewise by contacting with a receptor web delivered by a spool. When the photographic material itself is in the form of a web or ribbon the fixing web and photographic material are each supplied preferably from different spools between two parallel plates exerting some pressure to the contacting materials. By polishing the plates or coating them with polytetrafluoroethylene their friction is kept low so that a smooth passage of the contacting materials between the plates takes place. In connection herewith the attention is drawn to an apparatus suitable for web processing of pre-wetted photographic material and DTR-receptor material described in the already mentioned Neblette's Handbook of Photography and Reprography, p. 253–254 under the trade name DITRICON of HRB-Singer.

According to a preferred embodiment a receptor web applied in carrying out the present invention is supplied from a spool in dry state and brought together with a still wet developed photographic material on another spool for the accomplishment of the transfer of the dissolved silver halide and scavenging of its silver ions in the web. Thereupon the web is peeled apart from the film and web and film are wound on separate spools. The film is optionally rinsed and dried before storage. An arrangement for rapid film or web processing is illustrated in the already mentioned book of André Rott and Edith Weyde, p. 156.

To obtain a very rapid moistening the surface of the receptor web or sheet may be coated or contain a wetting agent. Examples of particularly useful wetting agents are fluoroalkyl wetting agents, e.g. of the type described in Belgian Patent Specification No. 742,680 and the anionic wetting agents described in EP No. 0 014 008.

According to a special embodiment the present method is adapted for the production of a "retained image" by a dye diffusion transfer process. For improving the transfer of (a) dye(s) the present receptor sheet or web contains also a mordanting agent for fixing the transferred dye(s).

A receptor element, e.g. sheet or web, for use in the production of a retained image by a dye diffusion transfer process according to the present invention and serving as silver halide fixing and dye receiving element contains on a support a water-absorbing receptor layer comprising a hydrophilic organic colloid as binding agent, a mordanting agent for fixing (a) dye(s), a silver halide complexing agent and silver metal nuclei in dispersed form capable of precipitating silver ions as silver metal, said silver metal nuclei being present at a coverage of at least 0.1 g per m2, and the coverage of said complexing agent being at least 5 mole % with respect to the molar per m2 of the silver halide present in the photographic material to be processed.

Several suitable embodiments for carrying out a dye diffusion transfer process are described by Christian C. Van de Sande in Angew. Chem. Int. Ed. Engl. 22 (1983) 191–209.

The terminology "retained image" is used e.g. in Research Disclosure (No. 17362) of December 1978 and relates to a dye diffusion transfer process wherein the image left (retained) in the photographic dye diffusion transfer material after image-wise removal of mobile or mobilized dye(s) is used as the final photographic product containing a silver image and dye image(s) in superposition. Such gives a considerable economy in silver comsumption since optical density is built up both by dye and silver metal. On bleaching the silver a monochrome or multicolour image can be obtained as retained image.

When anionic dyes have to be mordanted the water-absorbing layer used in the present receiving sheet or web contains cationic mordants, e.g. cationic polymeric mordants as described e.g. in U.S. Pat. No. 4,186,014, wherein a particularly useful mordanting agent prepared from 4,4'-diphenylmethane diisocyanate and N-ethyldiethanolamine quaternized with epichlorohydrine is described. Other useful mordanting agents are described in U.S. pat. No. 2,882,156, 2,484,430 and 3,271,147. The coverage of the mordanting sheet is e.g. in the range of 0.1 to 5.0 g per m2. The mordanting agent when itself having binding properties may play the role of hydrophilic colloid binding agent in the receptor sheet or web according to the present invention.

According to a particular embodiment a receptor element for use according to the present invention comprising a mordanting agent to remove from the photographic material an ionic dye as is the case in a dye diffusion transfer process can be used likewise to remove from common black-and-white photographic materials residual ionic chemicals, e.g. ionic residual oxidized or unoxidized developing agent, e.g. hydroquinone monosulphonate, spectral sensitizing dyes and/or filtering dyes to obtain a more white or cleaner image background. This may be of interest for the removal of dyes for radiographic materials that contain dyes for improving image sharpness as described e.g. in U.S. Pat. No. 4,130,428 according to which dyes are used in the photographic element to reduce cross-over light in silver halide emulsion layers that are coated at both sides of a transparent support.

The following examples illustrate the present invention without, however, limiting it thereto. All ratios and parts are by weight unless otherwise stated.

EXAMPLE 1

Preparation of silver metal nuclei dispersion.

Preparation of the starting solutions.

Solution A 500 g of silver nitrate were dissolved at 45° C. in 4000 ml of demineralized water.

Solution B 240 g of sodium hydroxide were dissolved at 45° C. in 14700 ml of demineralized water and 700 g of dextrin were added thereto while stirring.

Solution C 360 g of gelatin were dissolved in 1440 ml of demineralized water.

Solution D 600 g of citric acid were dissolved at 45° C. in 1030 ml of demineralized water.

While stirring solution A was added over a period of 1 min to solution B. After 5 min solution C was added to the mixture of solutions A and B and after 10 min solution D was added to the combined solutions A, B and C.

After 12 min of stirring an additional amount of 700 g of gelatin was added and the whole mixture was put on ice to set (setting time 10 h).

The gelled mass was washed with demineralized water to remove residual water-soluble compounds during which operation the pH raised from 3.8 to 5.6.

By heating the gel to 40° C. a stable dispersion of yellow colloidal silver containing 1.3 g of silver per 100 ml was obtained.

Preparation of receptor sheet

A coating composition was made by 3 min high speed stirring of the following ingredients

| | |
|---|---|
| silver dispersion (prepared as described above) | 100 g |
| sodium thiosulphate | 1.85 g |
| demineralized water | 49 ml |
| 1.4% aqueous solution of 7-ethyl-2-methyl-4-undecanol-H sulphate sodium salt as wetting agent | 1 ml |

The coating composition was applied on a subbed polyethylene terephthalate support at a wet coating thickness of 150 μm.

| | |
|---|---|
| The dried receptor layer contained per m2: | |
| yellow colloidal silver | 1.26 g |
| $Na_2S_2O_3$ | 1.85 g |
| gelatin | 4.50 g |

FIXING PROCESSING

A photographic paper material for use in phototype setting containing a gelatin - silver halide emulsion layer incorporating silver chloro-bromide-iodide grains (AgCl : 97.9 mole %, AgBr : 1.8 mole % and AgI : 0.3 mole %) at a coverage of silver halide equivalent with 1.86 g (0.01 mole) of silver nitrate per m2 and having an average grain size of 0.42 μm and a gelatin to silver halide ratio of 1 (the silver halide being expressed as an equivalent amount of silver nitrate) and including as developing agent hydroquinone at a coverage of 0.30 g per m2 was provided.

A strip of said photographic paper material being in half of its surface area exposed through a step wedge was treated at 20° C. for 5 s with an alkaline activator solution having the following composition :

| | |
|---|---|
| NaOH | 30 g |
| $Na_2SO_3$ | 50 g |
| NaBr | 2 g |
| ethylene diamine tetra-acetic acid Na-salt | 1.5 g |
| hydroxyethylcellulose | 2.5 g |
| 1.4% aqueous solution of 7-ethyl-2-methyl-4-undecanol-H sulphate sodium salt as wetting agent | 1 ml |
| distilled water up to | 1000 ml |
| | pH: 13.5 |

The still wet photographic material was put with its emulsion layer side into contact with the above receptor sheet and pressed in contact therewith at 20° C. for 1 min in a diffusion transfer processing apparatus COPYPROOF CP 38 (COPYPROOF is a trade name of Agfa-Gevaert N.V. Belgium), which apparatus was modified in such a way that the receptor sheet did not enter the tray containing the alkaline activator solution.

In said apparatus the photographic material wetted with said activator solution was pressed against the dry receptor sheet and after contact therewith the photographic material was led between a pair of hardrubber rollers removing still adhering liquid by squeegee action.

In the non-exposed area of the thus treated photographic material only an amount of silver equivalent with a coverage of 0.03 g $AgNO_3$/m2 was left.

EXAMPLE 2

A photographic microfilm material having a gelatin-silver halide emulsion layer incorporating silver bromide-iodide grains (AgBR : 99 mole % and AgI : 1 mole %) being applied at a coverage of silver halide equivalent with 2.06 g of silver nitrate per m2 and having an average grain size of 0.35 μm and a gelatin to silver halide ratio of 2 (the silver halide being expressed as an equivalent amount of silver nitrate) and including as developing agent hydroquinone at a coverage of 0.40 g per m2 was in half of its surface area exposed through a step wedge and treated at 20° C. for 5 s with the alkaline activator solution of Example 1.

The still wet photographic material was put with its emulsion layer side into contact with the receptor sheet wherein the dried receptor layer having a dry coating thickness of 10 um contained per m2 :

| | |
|---|---|
| yellow colloidal silver | 2.00 g |
| $Na_2S_2O_3$ | 2.90 g |
| hydroquinone | 0.25 g |
| $Na_2SO_3$ | 0.55 g |
| gelatin | 7.00 g |

The contact was carried out in the modified COPYPROOF CP 38 (trade name) apparatus used in Example 1 and lasted 1 min at 20° C. Adhering liquid was removed from the processed photographic material by hardrubber squeegee rollers. The non-exposed area contained after said treatment no silver anymore.

EXAMPLE 3

Preparation of silver metal nuclei dispersion

Preparation of the starting solutions

Solution A

An aqueous solution containing 2 % of $AgNO_3$ was prepared.

Solution B 30 g of gelatin were dissolved at 40° C. in 740 ml of demineralized water and thereupon the pH was raised to 8 by adding a 2 N aqueous sodium hydroxide solution.

Solution C 14 g of sodium sulphite and then 10 g of hydroquinone were dissolved in 166 ml of demineralized water.

While stirring 40 ml of solution A was added to solution B. After 5 min solution C was added to the mixture of solutions A and B.

After 10 min of stirring at 4° C. the whole mixture was put on ice to set.

The gelled mass was noodled and washed with demineralized water to remove residual water-soluble compounds.

By heating the gel to 40 ° C. a stable colloidal dispersion containing 1.3 g of silver and 3 g of gelatin per 100 ml was obtained.

PREPARATION OF RECEPTOR SHEET

A coating composition was made by 3 min high speed stirring of the following ingredients

| | |
|---|---|
| silver dispersion (prepared as described above) | 100 g |
| gelatin (20% aqueous solution) | 10 g |
| sodium thiosulphate | 2.50 g |
| sodium sulphite | 0.50 g |
| sodium bromide | 0.50 g |
| hydroquinone | 0.50 g |
| demineralized water | 20 ml |
| 20% aqueous solution of dextrin (average molecular weight 70,000) | 2 ml |
| 1.4% aqueous solution of 7-ethyl-2-methyl-4-undecanol-H sulphate sodium salt as wetting agent | 1 ml |

The coating composition was applied on a subbed polyethylene terephthalate support at a wet coating thickness of 130 μm.

| The dried receptor layer contained per m2: | |
|---|---|
| colloidal silver | 1.30 g |
| sodium thiosulphate | 2.50 g |
| sodium sulphite | 0.50 g |
| sodium bromide | 0.50 g |
| hydroquinone | 0.50 g |
| dextrin | 0.40 g |
| gelatin | 5.00 g |

FIXING PROCESSING

A photographic paper material for use in phototype setting containing a gelatin - silver halide emulsion layer incorporating silver chloro-bromide-iodide grains (AgCl : 97.9 mole %, AgBr : 1.8 mole % and AgI : 0.3 mole %) at a coverage of silver halide equivalent with 2.50 g of silver nitrate per m2 and having an average grain size of 0.42 um and a gelatin to silver halide ratio of 1 (the silver halide being expressed as an equivalent amount of silver nitrate) and including as developing agent hydroquinone at a coverage of 0.30 g per m2 was provided.

A strip of said photographic paper material being in half of its surface area exposed through a step wedge was treated at 20° C. for 5 s with an alkaline activator solution having the following composition :

| | |
|---|---|
| NaOH | 30 g |
| $Na_2SO_3$ | 50 g |
| NaBr | 2 g |
| ethylene diamine tetra-acetic acid Na-salt | 1.5 g |
| hydroxyethylcellulose | 2.5 g |
| 1.4% aqueous solution of 7-ethyl-2-methyl-4-undecanol-H sulphate sodium salt as wetting agent | 1 ml |
| distilled water up to | 1000 ml |
| | pH: 13.5 |

The still wet photographic material was put with its emulsion layer side into contact with the above receptor sheet and pressed in contact therewith at 20° C. for 1 min in a diffusion transfer processing apparatus COPYPROOF CP 38 (COPYPROOF is a trade name of Agfa-Gevaert N.V. Belgium), which apparatus was modified in such a way that the receptor sheet did not enter the tray containing the alkaline activator solution.

In said apparatus the photographic material wetted with said activator solution was pressed against the dry receptor sheet and after contact therewith the photographic material was led between a pair of hardrubber rollers removing still adhering liquid by squeegee action.

In the non-exposed area of the thus treated photographic material only an amount of silver equivalent with a coverage of 0.04 g $AgNO_3$/m2 was left after rinsing in running water for 15 s at 20° C.

EXAMPLE 4

Preparation of silver metal nuclei dispersion

The preparation proceeded as described in Example 3.

PREPARATION OF COLLOIDAL ZINC SULPHIDE

In a 5 l beaker were eput 300 g of $Na_2S.9\ H_2O$ in 1000 ml of distilled water. While vigourously stirring a solution of 400 g of $ZnSO_4.7\ H_2O$ in 1000 ml of distilled water were added to the sodium sulphide solution. After the addition stirring was continued for 10 min at room temperature (20° C.).

The formed colloidal precipitate was separated by filtering on a paper filter and washed on that filter with 1 l of distilled water. Thereupon washing was completed by mixing the precipitate with 2 l of distilled water and filtering again. The colloidal ZnS having an average grain size of 5 nm was kept in the form of s dispersion (slurry) containing 17 g of ZnS per 100 g. Yield of colloidal ZnS: 120 g.

The colloidal zinc sulphide was introduced into an aqueous gelatin solution to obtain a colloidal dispersion containing 3.3% of zinc sulphide and 5.4% of gelatin.

PREPARATION OF RECEPTOR SHEET

A coating composition was made by 3 min high speed stirring of the following ingredients

| | |
|---|---|
| colloidal silver dispersion | 80 g |
| colloidal zinc sulphide dispersion | 10 g |
| gelatin | 10 g |
| sodium thiosulphate | 1.50 g |
| sodium sulphite | 0.50 g |
| sodium bromide | 0.50 g |
| hydroquinone | 0.35 g |
| demineralized water | 20 ml |
| 20% aqueous solution of dextrin (average molecular weight 70,000) | 2 ml |
| 1.4% aqueous solution of 7-ethyl-2-methyl-4-undecanol-H sulphate sodium salt as wetting agent | 1 ml |

The coating composition was applied on a subbed polyethylene terephthalate support to form a dried receptor layer containing per m2 :

| | |
|---|---|
| colloidal silver | 1.00 g |
| colloidal zinc sulphide | 0.30 g |
| sodium thiosulphate | 1.50 g |
| sodium sulphite | 0.50 g |
| sodium bromide | 0.50 g |
| hydroquinone | 0.35 g |
| dextrin | 0.40 g |
| gelatin | 5.00 g |

FIXING PROCESSING

A photographic microfilm material containing a gelatin - silver halide emulsion layer incorporating silver chloro-bromide grains (AgCl : 1 mole %, AgBr : 99 mole %) at a coverage of silver halide equivalent with 2.10 g of silver nitrate per m2 and having an average grain size of 0.35 um and a gelatin to silver halide ratio of 1 (the silver halide being expressed as an equivalent amount of silver nitrate) was provided.

The silver halide emulsion layer contained 0.40 g/m2 of hydroquinone.

A strip of said photographic film material being in half of its surface area exposed through a step wedge was treated at 20° C. for 5 s with an alkaline activator solution having the following composition

| | |
|---|---|
| NaOH | 30 g |
| $Na_2SO_3$ | 50 g |
| NaBr | 2 g |
| ethylene diamine tetra-acetic acid Na-salt | 1.5 g |
| hydroxyethylcellulose | 2.5 g |
| 1.4% aqueous solution of 7-ethyl-2-methyl-4-undecanol-H sulphate sodium salt as wetting agent | 1 ml |
| distilled water up to | 1000 ml |
| | pH: 13.5 |

The still wet photographic material was put with its emulsion layer side into contact with the above receptor sheet and pressed in contact therewith at 20° C. for 1 min in a diffusion transfer processing apparatus COPYPROOF CP 38 (COPYPROOF is a trade name of Agfa-Gevaert N.V. Belgium), which apparatus was modified in such a way that the receptor sheet did not enter the tray containing the alkaline activator solution.

In said apparatus the photographic material still wet with said developer solution was pressed against the dry receptor sheet and after contact therewith the photographic material was led between a pair of hardrubber rollers removing still adhering liquid by squeegee action.

In the non-exposed area of the thus treated photographic material only an amount of silver equivalent with a coverage of 0.01 g of $AgNO_3$/m2 was left after rinsing in running water for 15 s at 20° C.

I claim:

1. An ecologically clean method for processing an imagewise exposed photographic material having a silver halide emulsion layer which method comprises the steps of:

(A) developing said image-wise exposed photographic material by means of (a) at least one diffusible developing agent in the absence of such an amount of silver halide solvent or complexing agent that would reduce the coverage of developed silver metal (Ag/m2) by more than 20%, using an aqueous alkaline liquid, (B) bringing the thus developed photographic material while being still wet with the liquid used in step (A) with its silver halide emulsion layer side into intimate contacat with a water-absorbing layer of a receptor element that contains in an organic hydrophilic colloid binder, a silver halide solvent or complexing agent, and in dispersed form silver metal nuclei, (C) maintaining said photographic material and receptor element in said contact to allow the transfer of dissolved complexed silver compound into the water-absorbing layer of said receptor element until the undeveloped silver halide in the exposed silver halide emulsion layer is substantially completely removed and a silver metal precipitate on said nuclei is formed in the water-absorbing layer of said receptor element, and (D) separating the photographic material from the receptor element, said water-absorbing layer containing said silver metal nuclei at a coverage of at least 0.1/g/m2, and said silver solvent or complexing agent at a coverage per m2 corresponding with at least 5 mole % of the molar coverage per m2 of silver halide in the unexposed photographic material.

2. Method according to claim 1, wherein the pH of the aqueous alkaline liquid used in step (A) is at least 9.

3. Method according to claim 1, wherein the aqueous alkaline liquid used in step (A) is free from any silver halide solvent.

4. Method according to claim 1, wherein in the receptor element in waterpermeable relationship with said colloidal silver metal nuclei an amount of colloidal heavy metal sulphide corresponding with a coverage in the range from $2.05\times10^{-4}$ mole/m2 to $2.05\times10^{-4}$ mold/m2 m2.$05\times10^{-2}$ is present. by heavy metal being meant a metal with an atomic number of at least 24.

5. Method according to claim 4, wherein said colloidal heavy metal sulphide is zinc sulphide.

6. Method according to claim 1, wherein the receptor element is initially dry before contacting the developed still wet photographic material.

7. Method according to claim 1, wherein the receptor element is a receptor 23b or sheet carrying said water-absorbing layer.

8. Method according to claim 1, wherein step (A) is carried out with an activator liquid initially free from any developing agent, said agent being present already in the exposed photographic material before development.

9. Method according to claim 1, wherein the hydrophilic colloid binder of the receptor element is gelatin.

10. Method according to claim 1, wherein the silver complexing agent is a watersoluble thiosulphate.

11. Method according to claim 10, wherein sodium thiosulphate is applied at a coverage of 0.50 g to 5 g per m2.

12. Method according to claim 1, wherein each such silver halide developing agent is present in the receptor element.

13. Method according to claim 12, wherein such developing agent is present in the receptor element in a coverage in the range of 0.1 g/m2 to 2 g/m2.

14. Method according to claim 12, wherein the receptor element contains a developing agent of the diffusion resistant type.

15. Method according to claim 1, wherein the photographic material contains at least one dye image providing substance adapted for carrying out a dye diffusion transfer process and the receptor element contains also a mordanting agent for fixing a dye image provided by at least one such substance, such substance being transferred into said receptor element by image-wise diffusion from the developed photographic silver halide material.

16. Method according to claim 15, wherein such dye is an anionic dye and the mordanting agent is a cationic polymeric mordanting agent.

17. Method according to claim 15, wherein the mordanting agent is present in the receptor element at a coverage in the range of 0.1 to 5 g per m2.

* * * * *

UNITED STATES PATENT AND TRADEMARK OFFICE

CERTIFICATE OF CORRECTION

PATENT NO. : 4,888,267

DATED : December 19, 1989

INVENTOR(S) : Gino L. De Rycke

It is certified that error appears in the above-identified patent and that said Letters Patent is hereby corrected as shown below:

In Claim 7, line 2, change "23b" to -- web --.

Signed and Sealed this

Thirtieth Day of October, 1990

*Attest:*

HARRY F. MANBECK, JR.

*Attesting Officer*

*Commissioner of Patents and Trademarks*